US011852334B2

(12) United States Patent
Wang et al.

(10) Patent No.: US 11,852,334 B2
(45) Date of Patent: Dec. 26, 2023

(54) BIOMASS BURNER

(71) Applicants: China National Tobacco Corporation Henan Provincial Company, Zhengzhou (CN); Xuchang Tongxing Modern Agricultural Science and Technology Co., Ltd., Xuchang (CN); Henan Agricultural University, Zhengzhou (CN)

(72) Inventors: Jian'an Wang, Zhengzhou (CN); Yikuan Fan, Zhengzhou (CN); Haobin Zhao, Zhengzhou (CN); Fengjie Wei, Zhengzhou (CN); Fangfang Li, Zhengzhou (CN); Lei He, Zhengzhou (CN); Pengfei Wang, Zhengzhou (CN); Yongjun Wang, Zhengzhou (CN); Jianhua Li, Zhengzhou (CN); Zhaopeng Song, Zhengzhou (CN); Feilong Shi, Zhengzhou (CN); Longfei Wang, Zhengzhou (CN); Weidong Guan, Zhengzhou (CN)

(73) Assignees: CHINA NATIONAL TOBACCO CORPORATION HENAN PROVINCIAL COMPANY, Zhengzhou (CN); XUCHANG TONGXING MODERN AGRICULTURAL SCIENCE AND TECHNOLOGY CO., LTD., Xuchang (CN); HENAN AGRICULTURAL UNIVERSITY, Zhengzhou (CN)

( * ) Notice: Subject to any disclaimer, the term of this patent is extended or adjusted under 35 U.S.C. 154(b) by 155 days.

(21) Appl. No.: 17/566,648

(22) Filed: Dec. 30, 2021

(65) Prior Publication Data

US 2022/0205632 A1 Jun. 30, 2022

(30) Foreign Application Priority Data

Dec. 31, 2020 (CN) ..... 202023296349.4

(51) Int. Cl.
*F23B 50/12* (2006.01)
*F24B 13/04* (2006.01)
(Continued)

(52) U.S. Cl.
CPC ..... *F23B 50/12* (2013.01); *A24B 3/12* (2013.01); *F23B 30/00* (2013.01); *F24B 13/04* (2013.01)

(58) Field of Classification Search
CPC .. F23B 50/12; F23B 30/00; F23L 5/02; F23G 2203/101; F23G 2205/121; F23G 2205/14; F23G 2209/26; F23G 7/10
See application file for complete search history.

(56) References Cited

U.S. PATENT DOCUMENTS 7,318,431 B1 * 1/2008 Holtan ..... F24B 1/024 126/10
9,140,448 B2 * 9/2015 Freeman ..... F23K 3/16
(Continued)

*Primary Examiner* — David J Laux
(74) *Attorney, Agent, or Firm* — MATTHIAS SCHOLL P.C.; Matthias Scholl

(57) ABSTRACT

A biomass burner includes a hopper, a ventilating chamber, a U-shaped fire box, a feeding cylinder including an output end, an auger, a feeding motor including a driving wheel, an ignition device, an ignition motor, a ventilation plate, a first poking device, a second poking device, a first poking motor configured to drive the first poking device, a second poking motor configured to drive the second poking device, a first fixed plate, and a second fixed plate. The hopper is disposed below the feeding cylinder. The feeding cylinder is disposed through the ventilating chamber and the output end of the feeding cylinder extends into the U-shaped fire box. The auger is disposed in the feeding cylinder and is driven by the
(Continued)

feeding motor; one end of the auger is provided with a driven gear, and the driven gear is meshed with the driving wheel of the feeding motor.

8 Claims, 5 Drawing Sheets

(51) Int. Cl.

| | |
|---|---|
| ***A24B 3/12*** | (2006.01) |
| ***F23L 5/02*** | (2006.01) |
| ***F23B 30/00*** | (2006.01) |

(56) References Cited

U.S. PATENT DOCUMENTS

| | | | | |
|---|---|---|---|---|
| 2007/0137538 | A1* | 6/2007 | Sterr | F23N 3/082<br>110/165 A |
| 2010/0089295 | A1* | 4/2010 | Moench | F23B 30/06<br>110/255 |
| 2018/0163962 | A1* | 6/2018 | Geselle | F23G 5/442 |

* cited by examiner

BIOMASS BURNER

CROSS-REFERENCE TO RELATED APPLICATIONS

Pursuant to 35 U.S.C. § 119 and the Paris Convention Treaty, this application claims foreign priority to Chinese Patent Application No. 202023296349.4 filed Dec. 31, 2020, the contents of which, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, MA 02142.

BACKGROUND

The disclosure relates to a biomass burner.

As a clean energy, biomass fuel has been used by many flue-cured tobacco producing countries. Traditionally, granular biomass fuel is put into a coal-fired furnace for direct combustion and heating. Due to the low density of granular fuel, a large number of combustible gasification gases escape from the chimney, leading to thermal loss. In addition, the harmful nitrogen and oxygen compounds produced in the combustion process of biomass fuel are much higher than that of coal combustion in the conventional biomass furnaces.

SUMMARY

A biomass burner comprises a hopper, a ventilating chamber, a U-shaped fire box, a feeding cylinder comprising an output end, an auger, a feeding motor comprising a driving wheel, an ignition device, an ignition motor, a ventilation plate, a first poking device, a second poking device, a first poking motor configured to drive the first poking device, a second poking motor configured to drive the second poking device, a first fixed plate, and a second fixed plate.

The hopper is disposed below the feeding cylinder; the feeding cylinder is disposed through the ventilating chamber and the output end of the feeding cylinder extends into the U-shaped fire box; the auger is disposed in the feeding cylinder and is driven by the feeding motor; one end of the auger is provided with a driven gear, and the driven gear is meshed with the driving wheel of the feeding motor.

The ventilating chamber is in the shape of a box, and comprises an outer seal plate disposed on one side of the hopper, an inner seal plate disposed on one side of the U-shaped fire box, and a plurality of side plates; the inner seal plate comprises a bottom ventilation hole, a horizontal air outlet, a first through hole, and a fuel outlet; the bottom ventilation hole is disposed on a lower end of the inner seal plate, and the ventilating chamber communicates with the U-shaped fire box through the bottom ventilation hole; the horizontal air outlet is disposed above the bottom ventilation hole, and the ventilating chamber further communicates with the U-shaped fire box through the bottom ventilation hole.

The ignition device is disposed in the ventilating chamber and lower than the feeding cylinder, and is driven by the ignition motor; and the ignition motor is disposed below the hopper; the outer seal plate comprises a second through hole, and the ignition device comprises a threaded transmission rod and a fire rod; the threaded transmission rod is disposed through the second through hole, and one end of the threaded transmission rod is connected to the ignition device, and other end thereof is connected to the fire rod; the fire rod is disposed through the first through hole of the inner seal plate and extends into the U-shaped fire box; the output end of the feeding cylinder is disposed through the fuel outlet, and a fuel in the feeding cylinder is driven by the auger to fall into the U-shaped fire box through the fuel outlet.

The ventilation plate is disposed vertically fixedly on an inner wall of the ventilating chamber and lower than the feeding cylinder; the ventilation plate comprises a plurality of ventilation holes, and the fire rod is disposed through the ventilation plate; the U-shaped fire box comprises a stepped base, and two sides of the stepped base are fixedly connected to two side walls of the U-shaped fire box, respectively; the stepped box comprises a plurality of vertical ventilation holes; a cavity is formed between the stepped base and a bottom wall of the U-shaped fire box, and communicates with the plurality of vertical ventilation holes and the bottom ventilation hole.

The stepped base comprises a first base and a second base; the first poking device and the second poking device are disposed in the ventilating chamber; the first poking device is disposed higher than the ignition device, and the second poking device is disposed lower than the ignition device; the first poking motor is disposed outside the outer seal plate to drive the first poking device, and the first poking device comprises a first power conversion device, a first transmission screw rod, and a first poker; one end of the first power conversion device is connected to the first poking motor, and the other end thereof is connected to one end of the first transmission screw rod; the other end of the first transmission screw rod is connected to one side of the first fixed plate; the first poker is connected to the other side of the first fixed plate.

The ventilation plate comprises a first sliding sleeve, and the first poker is disposed through the first sliding sleeve; the inner seal plate comprises a third through hole, and the first poker is disposed through the third through hole and extends into the U-shaped fire box; the second poking motor is disposed outside the outer seal plate to drive the second poking device, and the second poking device comprises a second power conversion device, a second transmission screw rod, and a second poker; one end of the second power conversion device is connected to the second poking motor, and the other end thereof is connected to one end of the second transmission screw rod; the other end of the second transmission screw rod is connected to one side of the second fixed plate; the second poker is connected to the other side of the second fixed plate; the ventilation plate comprises a second sliding sleeve, and the second poker is disposed through the second sliding sleeve; the bottom ventilation hole is disposed below the first base; the second poker is disposed through the bottom ventilation hole and extends into the U-shaped fire box; and one end of the second poker is provided with a cross bar.

In a class of this embodiment, a combustion-supporting fan is disposed outside the outer seal plate; the outer seal plate further comprises a fourth through hole, and an output shaft of the combustion-supporting fan is disposed through the fourth through hole.

In a class of this embodiment, a flame detector is disposed on the ventilation plate.

In a class of this embodiment, an access opening is disposed on a head of the feeding cylinder.

In a class of this embodiment, the first power conversion device and the second power conversion device are identical in structure, and each comprises two nuts and three connecting strips connected between the two nuts; the two nuts are respectively disposed on two ends of the first power conversion device and the second power conversion device, and the three connecting strips are evenly disposed around the two nuts.

In a class of this embodiment, the ventilation plate comprises a groove and the fire rod is disposed through the groove; the fire rod is connected to the threaded transmission rod; and the fire rod is driven by the threaded transmission rod, squeezed by the groove, and moves back and forth into and out of the U-shaped fire box.

In a class of this embodiment, the outer seal plate comprises a mounting hole, a first connection hole, and a second connection hole; the feeding cylinder is disposed through the mounting hole and extends into the ventilating chamber; an output shaft of the first poking motor is disposed through the first connection hole and connected to the first power conversion device; and an output shaft of the second poking motor is disposed through the second connection hole and connected to the second power conversion device.

In a class of this embodiment, a furnace crown is disposed on one side of the U-shaped fire box next to the inner seal plate.

The following advantages are associated with the biomass burner of the disclosure. The biomass burner comprises a stepped base instead of a conventional flat base, thus effectively balancing the flame distribution of biomass fuel in the furnace. The flame heads are multiple instead of a conventional centralized single flame head, thus preventing centralized heating by one single flame head. The flame temperature can be effectively controlled below 1000° C., thus reducing the amount of nitrogen oxides mainly produced by a single flame above 1300° C. Thus, in the biomass burner of the disclosure, the biomass is completely burned, reducing the heat loss.

Figure 1:
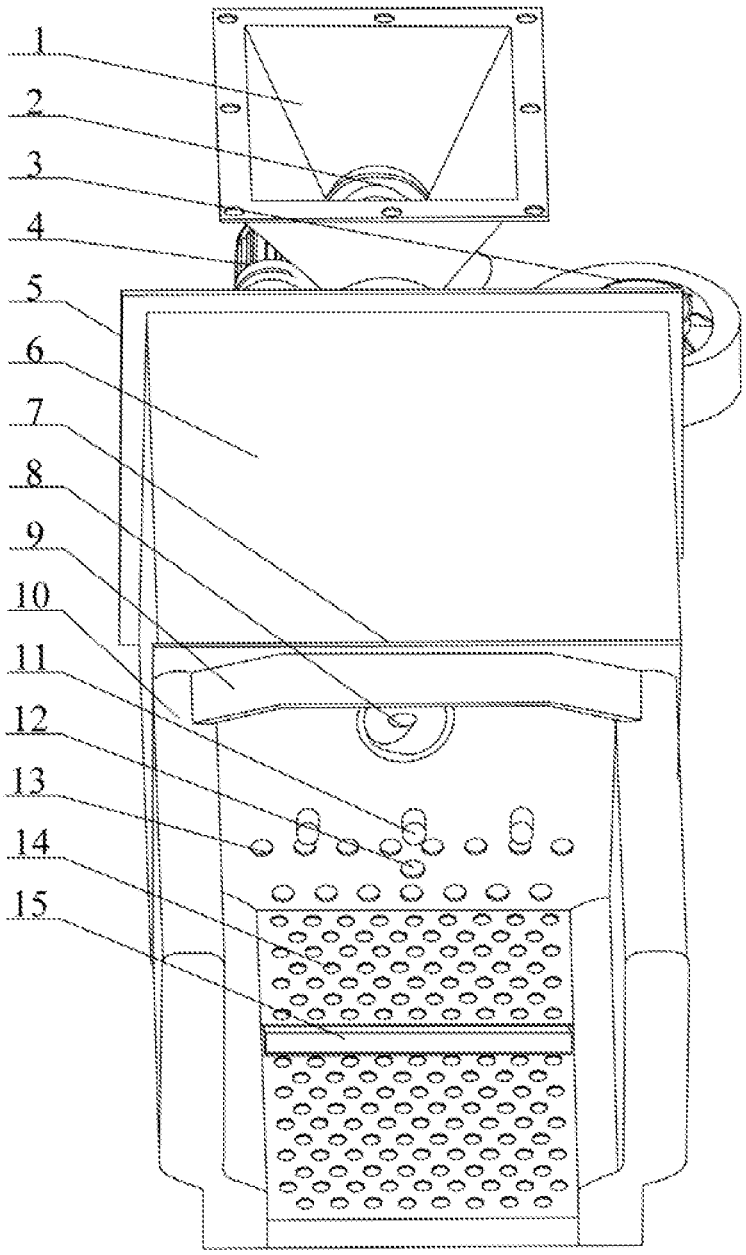
FIG. 1 is a schematic diagram of a biomass burner according to one embodiment of the disclosure.

In the drawings, the following reference numbers are used: 1. Hopper; 2. Auger; 3. Combustion-supporting fan; 4. Feeding motor; 5. Outer seal plate; 6. Ventilating chamber; 7. Inner seal plate; 8. Fuel outlet; 9. Furnace crown; 10. U-shaped fire box; 11. First poker; 12. First through hole; 13. Horizontal air outlet; 14. Vertical ventilation hole; 15. Cross bar; 16. Feeding cylinder; 17. Access opening; 18. First poking motor; 19. Ignition motor; 20. Second poking motor; 21. Second power conversion device; 22. Second transmission screw rod; 23. Groove; 24. Second fixed plate; 25. Second sliding sleeve; 26. Ventilation plate; 27. Second poker; 28. Bottom ventilation hole; 29. First transmission screw rod; 30. Threaded transmission rod; 31. First fixed plate; 32. First sliding sleeve; 33. Flame detector; 34. Fire rod; 35. First power conversion device; 36. Fourth through hole; 37. Second through hole; 38. Second connection hole; 39. Mounting hole; 40. First connection hole; 41. First base; and 42. Second base.

DETAILED DESCRIPTION

To further illustrate, embodiments detailing a biomass burner are described below. It should be noted that the following embodiments are intended to describe and not to limit the disclosure.

Figure 2:
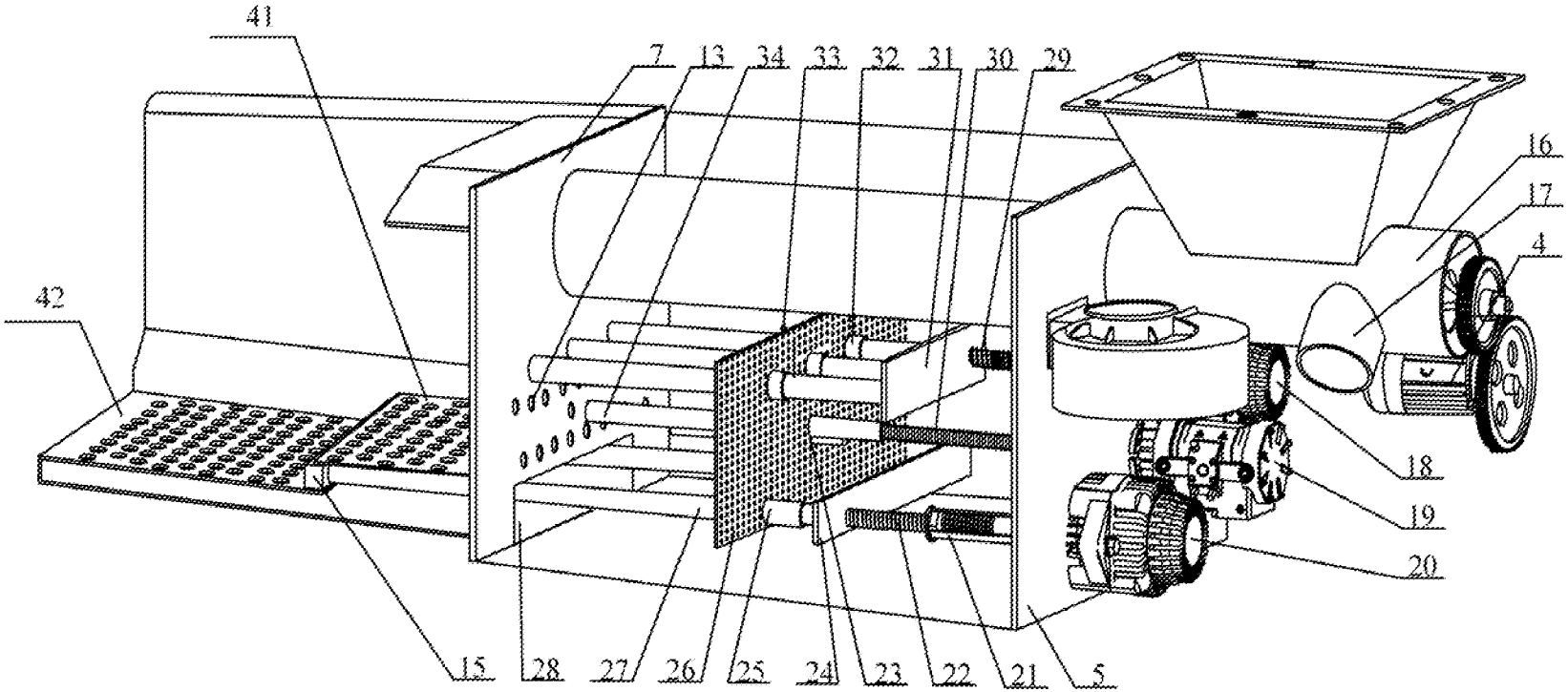
FIG. 2 is a sectional view of a biomass burner according to one embodiment of the disclosure.
Figure 3:
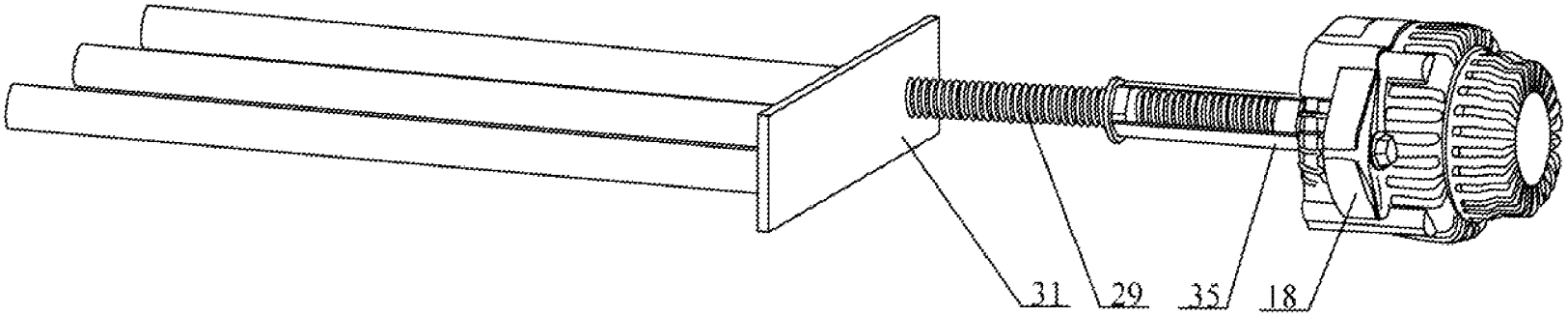
FIG. 3 is a schematic diagram of a first poking device of a biomass burner according to one embodiment of the disclosure.
Figure 4:
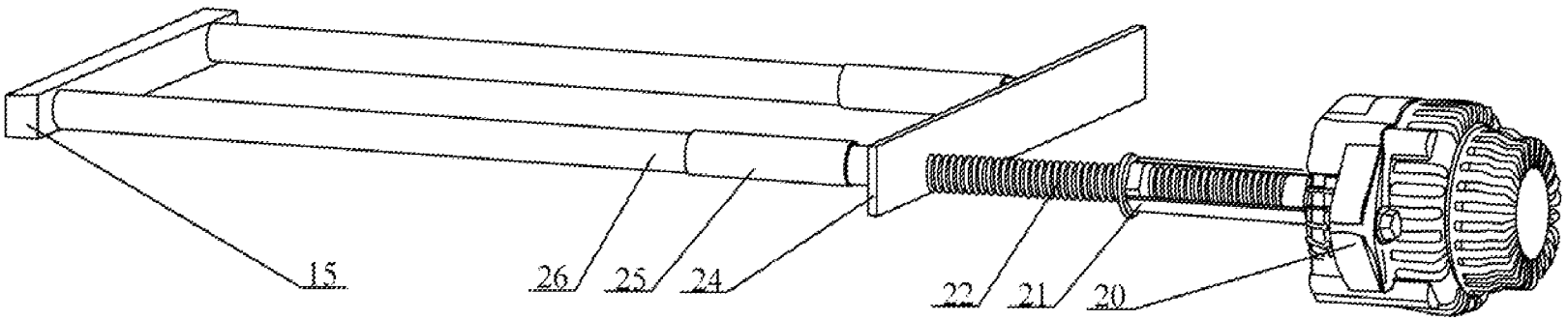
FIG. 4 is a schematic diagram of a second poking device of a biomass burner according to one embodiment of the disclosure.
Figure 5:
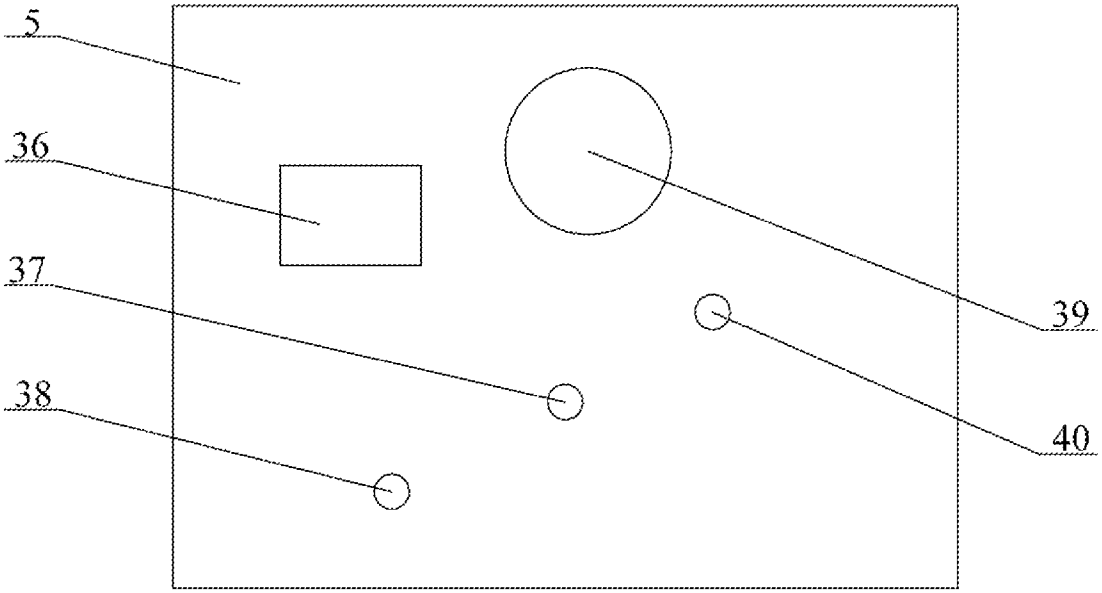
FIG. 5 is a schematic diagram of an outer seal plate of a biomass burner according to one embodiment of the disclosure.

Referring to FIGS. 1-5, the disclosure provides a biomass burner for flue-cured tobacco comprising a hopper 1, a ventilating chamber 6, a U-shaped fire box 10, a feeding cylinder 16 comprising an output end, an auger 2, a feeding motor 4 comprising a driving wheel, an ignition device, an ignition motor 19, a ventilation plate 26, a first poking device, a second poking device, a first poking motor 18 configured to drive the first poking device, a second poking motor 20 configured to drive the second poking device, a first fixed plate 31, and a second fixed plate 24. The hopper 1 is disposed below the feeding cylinder 16. An access opening 17 is disposed on the head of the feeding cylinder 16. The feeding cylinder 16 is disposed through the ventilating chamber 6 and the output end of the feeding cylinder 16 extends into the U-shaped fire box 10. The output end of the feeding cylinder 16 is disposed through the fuel outlet 8 of the inner seal plate 7. The auger 2 is disposed in the feeding cylinder 16 and is driven by the feeding motor 4. Specifically, one end of the auger 2 is provided with a driven gear, and the driven gear is meshed with the driving wheel of the feeding motor 4 to drive the auger 2 to rotate, so that the fuel in the feeding cylinder falls into the U-shaped fire box 10 through the fuel outlet 8.

The ventilating chamber 6 is in the shape of a box, and comprises an outer seal plate 5 disposed on one side of the hopper 1, an inner seal plate 7 disposed on one side of the U-shaped fire box 10, and a plurality of side plates. The inner seal plate comprises a bottom ventilation hole 28, a horizontal air outlet 13, and a first through hole 12. The bottom ventilation hole 28 is disposed on the lower end of the inner seal plate, and the ventilating chamber 6 communicates with the U-shaped fire box 10 through the bottom ventilation hole 28; the horizontal air outlet 13 is disposed above the bottom ventilation hole 28, and the ventilating chamber 6 further communicates with the U-shaped fire box 10 through the bottom ventilation hole. The ventilation plate 26 is disposed vertically fixedly on the inner wall of the ventilating chamber 6 and lower than the feeding cylinder 16; the ventilation plate 26 comprises a plurality of ventilation holes. A flame detector 33 is disposed on the ventilation plate 26 to detect the flame in the U-shaped fire box. The ignition device is disposed in the ventilating chamber 6 and lower than the feeding cylinder 16, and is driven by the ignition motor 19; and the ignition motor 19 is disposed outside the outer seal plate 5 and below the hopper 1. The outer seal plate 5 comprises a second through hole 37, and the ignition device comprises a threaded transmission rod 30 and a fire rod 34; the threaded transmission rod 30 is disposed through the second through hole 37, and one end of the threaded transmission rod 30 is connected to the ignition device, and other end thereof is connected to the fire rod 34; the fire rod 34 is disposed through the ventilation plate 26 and the first through hole 12 of the inner seal plate 7 and then extends into the U-shaped fire box 10. Specifically, the ventilation plate 26 comprises a groove 23 and the fire rod 34 is disposed through the groove 23; the fire rod 34 is connected to the threaded transmission rod 30; and the fire rod is driven by the threaded transmission rod, squeezed by the groove, and moves back and forth into and out of the U-shaped fire box. When the fire rod 34 is withdrawn into the ventilating chamber through the first through hole 12, the first through hole 12 functions as a horizontal ventilation hole.

A furnace crown 9 is disposed on one side of the U-shaped fire box 10 next to the inner seal plate 7. The U-shaped fire box 10 comprises a stepped base, and two sides of the stepped base are fixedly connected to two side walls of the U-shaped fire box 10, respectively; the stepped box comprises a plurality of vertical ventilation holes 14; a cavity is formed between the stepped base and a bottom wall of the U-shaped fire box 10, and communicates with the plurality of vertical ventilation holes 14 and the bottom ventilation hole 28. The stepped base comprises one or more bases. For example, the stepped base comprises a first base 41 and a second base 42; the bottom surface of the first base 41 is higher than the bottom ventilation hole 28, and the upper surface of the first base 41 is lower than the horizontal air outlet 13. The first poking device and the second poking device are disposed in the ventilating chamber 6; the first poking device is disposed higher than the ignition device, and the second poking device is disposed lower than the ignition device.

The first poking motor 18 is disposed outside the outer seal plate 5 to drive the first poking device, and the first poking device comprises a first power conversion device 35, a first transmission screw rod 29, and a first poker 11. Specifically, the output shaft of the first poking motor 18 is disposed through the first connection hole 40 and connected to one end of the first power conversion device 35, and the other end of the first power conversion device 35 is connected to one end of the first transmission screw rod 29; the other end of the first transmission screw rod 29 is connected to one side of the first fixed plate 31; the first poker 11 is connected to the other side of the first fixed plate 31. In this example, three first pokers 11 are provided. The ventilation plate comprises a first sliding sleeve 32, and the first poker 11 is disposed through the first sliding sleeve 32; the inner seal plate 7 comprises a third through hole, and the first poker is disposed through the third through hole and extends into the U-shaped fire box 10. The second poking motor 20 is disposed outside the outer seal plate 5 to drive the second poking device, and the second poking device comprises a second power conversion device 21, a second transmission screw rod 22, and a second poker 27. The output shaft of the second poking motor 20 is disposed through the second connection hole 38 and connected to one end of the second power conversion device 21, and the other end of the second power conversion device 21 is connected to one end of the second transmission screw rod 22; the other end of the second transmission screw rod 22 is connected to one side of the second fixed plate 24; the second poker 27 is connected to the other side of the second fixed plate 24. In this example, two second pokers are provided. The ventilation plate comprises a second sliding sleeve 25, and the second poker 27 is disposed through the second sliding sleeve 25; the bottom ventilation hole 28 is disposed below the first base; the second poker 27 is disposed through the bottom ventilation hole 28 and extends into the U-shaped fire box 10; and one end of the second poker 27 is provided with a cross bar 15. The second poker 27 brings along the cross bar 15 to move back and forth in the space between the first base 41 and the second base 42 to clean the first base. The first power conversion device 35 and the second power conversion device 21 are identical in structure, and each comprises two nuts and three connecting strips connected between the two nuts; the two nuts are respectively disposed on two ends of the first power conversion device and the second power conversion device, and the three connecting strips are evenly disposed around the two nuts.

As an improvement, a combustion-supporting fan 3 is disposed outside the outer seal plate 5; the outer seal plate 5 further comprises a fourth through hole 36, and an output shaft of the combustion-supporting fan 3 is disposed through the fourth through hole 36.

When in use, the functional components of a heating apparatus are connected to the tobacco control device. Under the action of the signal control end, the feeding device is connected to the feeding motor 4, the ignition device is connected to the ignition motor 19, the first poking device is connected to the first poking motor 18, the second poking device is connected to the second poking motor 20, and the signal input end is connected to the flame detector 33 in the ventilating chamber.

Second, a material box is disposed on the hopper 1, so as to increase the loading capacity of fuel.

Third, at the beginning of tobacco curing, the temperature and heating time are set by the tobacco control device. Because the set temperature is higher than the actual temperature in the curing room, the control device controls the feeding system to start conveying particle biomass fuel to the U-shaped fire box. The signal control end of the feeding device transmits an electrical signal to the feeding motor 4. The feeding motor 4 operates and transmits the power to the auger 2 in the feeding cylinder 16 through the driving wheel set. The auger 2 rotates to transport the biomass fuel in the hopper 1 to the first base 41 of the U-shaped fire box through the fuel outlet 8.

At the same time, the control device sends a signal to the ignition motor 19. The ignition motor 19 rotates forward to drive the threaded transmission rod 30. The fire rod is pressed and pushed through the groove 23 on the ventilation plate 26, and enters the biomass pile in the furnace through the first through hole 12. The fire rod 34 heats up and ignites the biomass fuel.

Fourth, in synchronization with the operation of the fire rod 34, the control device controls the combustion-supporting fan 3 to start working. Because the ventilating chamber 6 is sealed, the generated air enters the furnace through the horizontal air outlet 13 and the bottom ventilation hole 28 to provide oxygen for fuel combustion.

Fifth, when the ignited biomass fuel generates a flame, the flame detector 33 on the ventilation plate 26 in the ventilating chamber 6 detects that the biomass fuel in the furnace chamber has been burned, the control device controls the reverse rotation of the ignition motor 19, and the fire rod 34 withdraws to the original position. Thus, the first through hole 12 functions as another horizontal ventilation hole 13. During tobacco curing, if the flame detector 33 finds that the flame in the furnace is extinguished, the control system restarts the ignition program again.

Sixth, when the feeding motor 4 works, the control device starts to calculate the number of rotations of the feeding motor. When the number of rotations reaches a certain number, the control device outputs an electrical signal to the first poking device 18 to drive the first poker 11 to complete the ash management in the first stage. After the first poking device 18 works for one cycle, the number of operations is recorded. When the number reaches to certain times, the second poking motor 20 starts to work, and drive the cross bar 15 to clean the first base.

Seventh, when the curing of the tobacco is finished, the feeding motor 4 stops working. When the flame detector 33 cannot detect the flame, in order to protect various devices in the ventilating chamber 6, the combustion-supporting fan 3 continues working for 15 minutes and then stops working.

It will be obvious to those skilled in the art that changes and modifications may be made, and therefore, the aim in the appended claims is to cover all such changes and modifications.

What is claimed is:

1. A biomass burner, comprising:

a hopper;

a ventilating chamber;

a U-shaped fire box;

a feeding cylinder comprising an output end;

an auger;

a feeding motor comprising a driving wheel;

an ignition device;

an ignition motor;

a ventilation plate;

a first poking device;

a second poking device;

a first poking motor configured to drive the first poking device;

a second poking motor configured to drive the second poking device;

a first fixed plate; and a second fixed plate;

wherein:

the hopper is disposed below the feeding cylinder;

the feeding cylinder is disposed through the ventilating chamber and the output end of the feeding cylinder extends into the U-shaped fire box;

the auger is disposed in the feeding cylinder and is driven by the feeding motor;

one end of the auger is provided with a driven gear, and the driven gear is meshed with the driving wheel of the feeding motor;

the ventilating chamber is in the shape of a box, and comprises an outer seal plate disposed on one side of the hopper, an inner seal plate disposed on one side of the U-shaped fire box, and a plurality of side plates;

the inner seal plate comprises a bottom ventilation hole, a horizontal air outlet, a first through hole, and a fuel outlet; the bottom ventilation hole is disposed on a lower end of the inner seal plate, and the ventilating chamber communicates with the U-shaped fire box through the bottom ventilation hole; the horizontal air outlet is disposed above the bottom ventilation hole, and the ventilating chamber further communicates with the U-shaped fire box through the bottom ventilation hole;

the ignition device is disposed in the ventilating chamber and lower than the feeding cylinder, and is driven by the ignition motor; and the ignition motor is disposed below the hopper;

the outer seal plate comprises a second through hole, and the ignition device comprises a threaded transmission rod and a fire rod; the threaded transmission rod is disposed through the second through hole, and one end of the threaded transmission rod is connected to the ignition device, and other end thereof is connected to the fire rod; the fire rod is disposed through the first through hole of the inner seal plate and extends into the U-shaped fire box; the output end of the feeding cylinder is disposed through the fuel outlet, and a fuel in the feeding cylinder is driven by the auger to fall into the U-shaped fire box through the fuel outlet;

the ventilation plate is disposed vertically fixedly on an inner wall of the ventilating chamber and lower than the feeding cylinder; the ventilation plate comprises a plurality of ventilation holes, and the fire rod is disposed through the ventilation plate;

the U-shaped fire box comprises a stepped base, and two sides of the stepped base are fixedly connected to two side walls of the U-shaped fire box, respectively; the stepped box comprises a plurality of vertical ventilation holes; a cavity is formed between the stepped base and a bottom wall of the U-shaped fire box, and communicates with the plurality of vertical ventilation holes and the bottom ventilation hole;

the stepped base comprises a first base and a second base; the first poking device and the second poking device are disposed in the ventilating chamber; the first poking device is disposed higher than the ignition device, and the second poking device is disposed lower than the ignition device;

the first poking motor is disposed outside the outer seal plate to drive the first poking device, and the first poking device comprises a first power conversion device, a first transmission screw rod, and a first poker; one end of the first power conversion device is connected to the first poking motor, and the other end thereof is connected to one end of the first transmission screw rod; the other end of the first transmission screw rod is connected to one side of the first fixed plate; the first poker is connected to the other side of the first fixed plate;

the ventilation plate comprises a first sliding sleeve, and the first poker is disposed through the first sliding sleeve; the inner seal plate comprises a third through hole, and the first poker is disposed through the third through hole and extends into the U-shaped fire box;

the second poking motor is disposed outside the outer seal plate to drive the second poking device, and the second poking device comprises a second power conversion device, a second transmission screw rod, and a second poker; one end of the second power conversion device is connected to the second poking motor, and the other end thereof is connected to one end of the second transmission screw rod; the other end of the second transmission screw rod is connected to one side of the second fixed plate; the second poker is connected to the other side of the second fixed plate;

the ventilation plate comprises a second sliding sleeve, and the second poker is disposed through the second sliding sleeve; the bottom ventilation hole is disposed below the first base; the second poker is disposed through the bottom ventilation hole and extends into the U-shaped fire box; and one end of the second poker is provided with a cross bar.

2. The burner of claim 1, wherein a combustion-supporting fan is disposed outside the outer seal plate; the outer seal plate further comprises a fourth through hole, and an output shaft of the combustion-supporting fan is disposed through the fourth through hole.

3. The burner of claim 1, wherein a flame detector is disposed on the ventilation plate.

4. The burner of claim 1, wherein an access opening is disposed on a head of the feeding cylinder.

5. The burner of claim 1, wherein the first power conversion device and the second power conversion device are identical in structure, and each comprises two nuts and three connecting strips connected between the two nuts; the two nuts are respectively disposed on two ends of the first power conversion device and the second power conversion device, and the three connecting strips are evenly disposed around the two nuts.

6. The burner of claim 1, wherein the ventilation plate comprises a groove and the fire rod is disposed through the groove; the fire rod is connected to the threaded transmission rod; and the fire rod is driven by the threaded transmission rod, squeezed by the groove, and moves back and forth into and out of the U-shaped fire box.

7. The burner of claim 1, wherein the outer seal plate comprises a mounting hole, a first connection hole, and a second connection hole; the feeding cylinder is disposed through the mounting hole and extends into the ventilating chamber; an output shaft of the first poking motor is disposed through the first connection hole and connected to the first power conversion device; and an output shaft of the second poking motor is disposed through the second connection hole and connected to the second power conversion device.

8. The burner of claim 1, wherein a furnace crown is disposed on one side of the U-shaped fire box next to the inner seal plate.

* * * * *